US010401052B2

(12) United States Patent
Heinrichs

(10) Patent No.: US 10,401,052 B2
(45) **Date of Patent: *Sep. 3, 2019**

(54) AIR VENT

(71) Applicant: TPMH Holdings LLC, Kingston, MA (US)

(72) Inventor: Michael Heinrichs, Weymouth, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/105,834

(22) Filed: Aug. 20, 2018

(65) Prior Publication Data

US 2018/0356122 A1 Dec. 13, 2018

Related U.S. Application Data

(63) Continuation of application No. 15/843,042, filed on Dec. 15, 2017, now Pat. No. 10,054,331, which is a continuation of application No. 15/286,622, filed on Oct. 6, 2016, now Pat. No. 9,845,970.

(60) Provisional application No. 62/352,457, filed on Jun. 20, 2016.

(51) Int. Cl.

| | |
|---|---|
| ***F24F 13/14*** | (2006.01) |
| ***E04B 2/02*** | (2006.01) |
| *F24F 7/00* | (2006.01) |

(52) U.S. Cl.

CPC ..... *F24F 13/14* (2013.01); *E04B 2/02* (2013.01); *F24F 2007/001* (2013.01); *F24F 2007/003* (2013.01)

(58) Field of Classification Search

CPC ..... F24F 13/14; F24F 2007/003; F24F 2007/001; E04B 2/02

USPC ..... 52/302.1; 454/365, 358, 363, 364, 366, 454/361

See application file for complete search history.

(56) References Cited

U.S. PATENT DOCUMENTS

| | | | | |
|---|---|---|---|---|
| 2,020,094 A * | 11/1935 | Bayley | E06B 9/01 | 52/204.51 |
| 6,447,390 B1 * | 9/2002 | O'Hagin | E04D 1/30 | 454/250 |
| 6,491,579 B1 * | 12/2002 | O'Hagin | E04D 1/30 | 454/250 |
| D588,255 S * | 3/2009 | Daniels | D23/373 | |
| D593,193 S * | 5/2009 | Jackson | D23/371 | |
| 7,610,726 B2 * | 11/2009 | Lajewski | F24F 7/00 | 248/220.21 |

(Continued)

*Primary Examiner* — Brent W Herring

(57) ABSTRACT

Disclosed is an air vent for mounting directly to an exterior wall of a structure to allow air flow from an interior space of the structure to the ambient environment. The air vent comprises a body comprising an opening and a siding portion disposed below the opening. The air vent further comprises a first siding piece secured to the siding portion that is substantially similar to the siding of the exterior wall. The air vent further comprises a damper moveably engaged with the body between a closed position where the damper blocks air flow thru the opening and an open position where the damper allows air flow thru the opening. The air vent further comprises a second siding piece secured to the damper that is substantially similar to and overlaps the first siding piece in the closed position. Unlike conventional devices, the air vent of the present invention blends into the siding on the exterior wall increasing the aesthetic appearance of the siding.

20 Claims, 10 Drawing Sheets

(56) References Cited

U.S. PATENT DOCUMENTS 7,618,310 B2 * 11/2009 Daniels ..... E04D 13/008 454/366
7,901,278 B2 * 3/2011 O'Hagin ..... E04D 1/30 454/365
8,425,288 B1 * 4/2013 Snipes, Jr. ..... F24F 13/082 454/271
8,793,943 B2 * 8/2014 Daniels ..... E04D 1/26 52/198
9,003,730 B2 * 4/2015 Daniels ..... E04D 1/26 52/198
9,394,693 B2 * 7/2016 Daniels ..... E04D 13/00
9,845,970 B2 * 12/2017 Heinrichs ..... E04B 2/02
D827,122 S * 8/2018 Heinrichs ..... D23/393
2006/0052047 A1 * 3/2006 Daniels, II ..... E04D 12/004 454/237
2007/0072541 A1 * 3/2007 Daniels, II ..... F24F 7/02 454/365
2007/0207725 A1 * 9/2007 O'Hagin ..... E04D 13/008 454/365
2007/0232217 A1 * 10/2007 Davis ..... F24F 13/082 454/330
2008/0098674 A1 * 5/2008 Daniels ..... E04D 1/045 52/199
2010/0257798 A1 * 10/2010 Ward ..... F24F 7/02 52/301
2010/0330898 A1 * 12/2010 Daniels ..... E04D 13/17 454/365
2013/0019548 A1 * 1/2013 Daniels ..... E04D 1/26 52/198
2014/0331583 A1 * 11/2014 Daniels ..... E04D 1/26 52/302.1
2015/0143760 A1 * 5/2015 Daniels ..... E04D 13/00 52/173.1
2015/0253021 A1 * 9/2015 Daniels ..... E04D 1/30 454/341
2015/0259921 A1 * 9/2015 Daniels ..... E04D 1/26 52/198
2016/0289970 A1 * 10/2016 Daniels ..... E04D 13/00
2017/0022702 A1 * 1/2017 Heinrichs ..... E04B 2/02

* cited by examiner

AIR VENT

CROSS-REFERENCE TO RELATED APPLICATIONS

This application is a continuation of and claims priority to U.S. Utility patent application Ser. No. 15/843,042 filed on Dec. 15, 2017, now pending, which is a continuation of and claims priority to U.S. Utility patent application Ser. No. 15/286,622 filed on Oct. 6, 2016, now U.S. Pat. No. 9,845,970, which claims priority to U.S. Provisional Application Ser. No. 62/352,457 filed on Jun. 20, 2016, all of which are hereby incorporated into this specification by reference in their entirety.

BACKGROUND OF THE INVENTION

Air vents are widely used to exhaust air from an interior space of a structure (such as a home) to the ambient environment. FIG. 1 shows a conventional air vent 2 mounted directly to siding 18 (such as wood shingles) of an exterior wall 16 of the structure (not shown) by fastening means such as nails (not shown). Air vent 2 has an opening (not shown) and a rear duct (not shown) that engages with a supply duct (not shown) located in the interior space of the structure. Air vent 2 has a body 4 and damper 6 that may be spring loaded or otherwise configured such that it will open when a high amount of air flow is present and close upon the presence of a low amount of air flow. Air vent 2 also has a cover 108 substantially enclosing damper 6. Air vent 2 has at least one significant drawback. Air vent 2 is mounted directly to the siding of the exterior wall. As such, body 4, damper 6, and cover 108 of air vent 2 protrude outward from siding 18 thereby significantly diminishing the aesthetic appearance of siding 18 and the value of the structure.

SUMMARY OF THE INVENTION

The present invention is an air vent that can be mounted to an exterior wall of a structure such that the air vent blends into the siding thereby making the air vent substantially invisible. The air vent comprises a body comprising an opening and a siding portion disposed below the opening. The air vent further comprises a first siding piece secured to the siding portion that is substantially similar to the siding of the exterior wall. The air vent further comprises a damper moveably engaged with the body between a closed position where the damper prevents air flow thru the opening and an open position where the damper allows air flow thru the opening. The air vent further comprises a second siding piece secured to the damper that is substantially similar to the siding of the exterior wall and overlaps the first siding piece in the closed position. Unlike conventional devices, the air vent of the present invention blends into the siding of the exterior wall making the air vent substantially invisible and increasing the aesthetic appearance of the siding and value of the structure.

BRIEF DESCRIPTION OF THE DRAWINGS

The following description of the invention will be further understood with reference to the accompanying drawings, in which.

DESCRIPTION OF THE INVENTION

Figure 1:
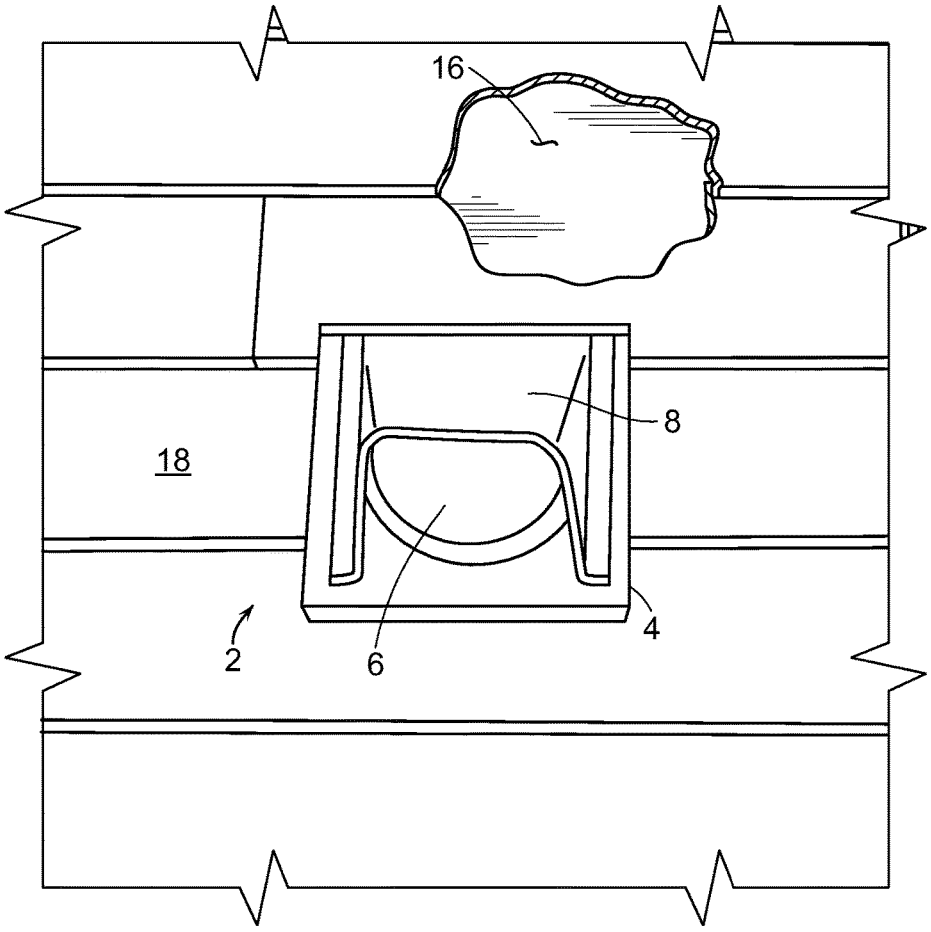
FIG. 1 (PRIOR ART)
FIG. 1 is a perspective view of a prior art air vent mounted directly to the siding of an exterior wall of a structure.
Figure 2:
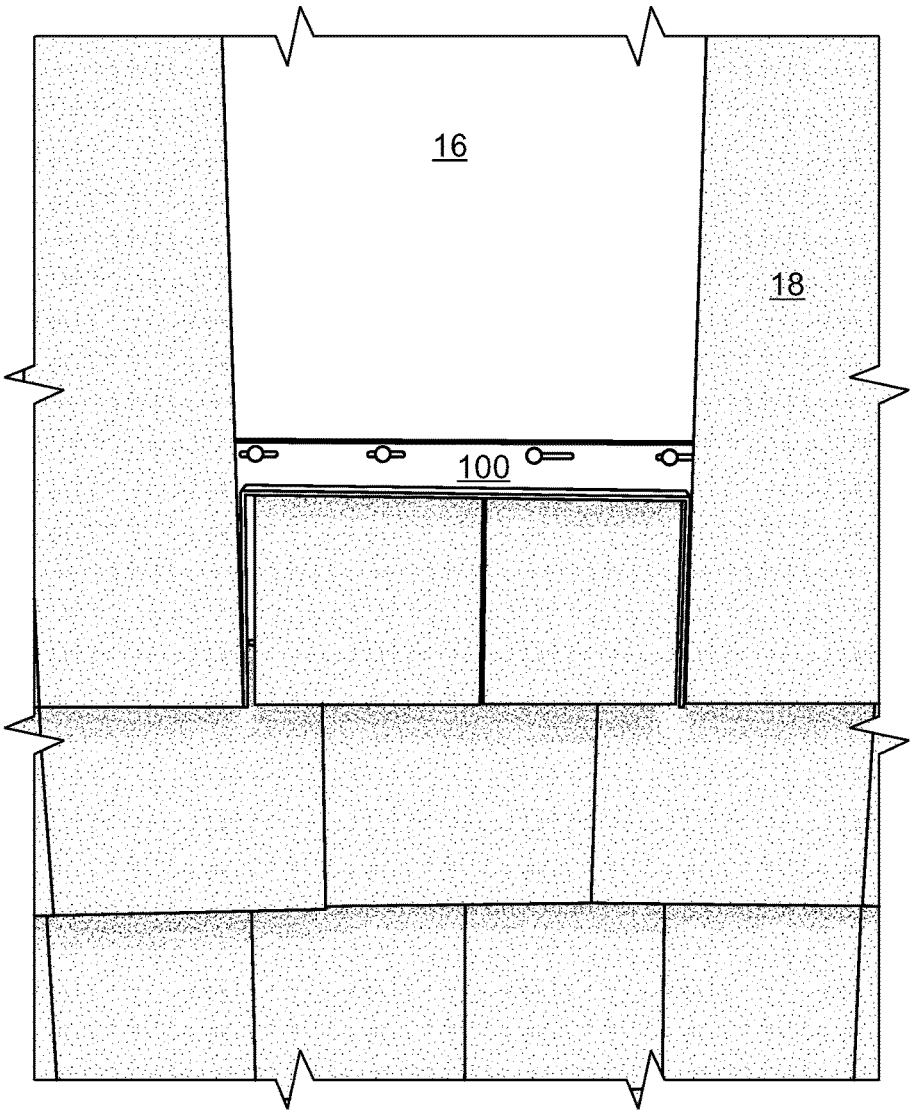
FIG. 2 is a perspective view of an air vent according to the present invention directly mounted to an exterior wall of a structure underneath the adjacent siding and shown in an operating or open position.
Figure 3:
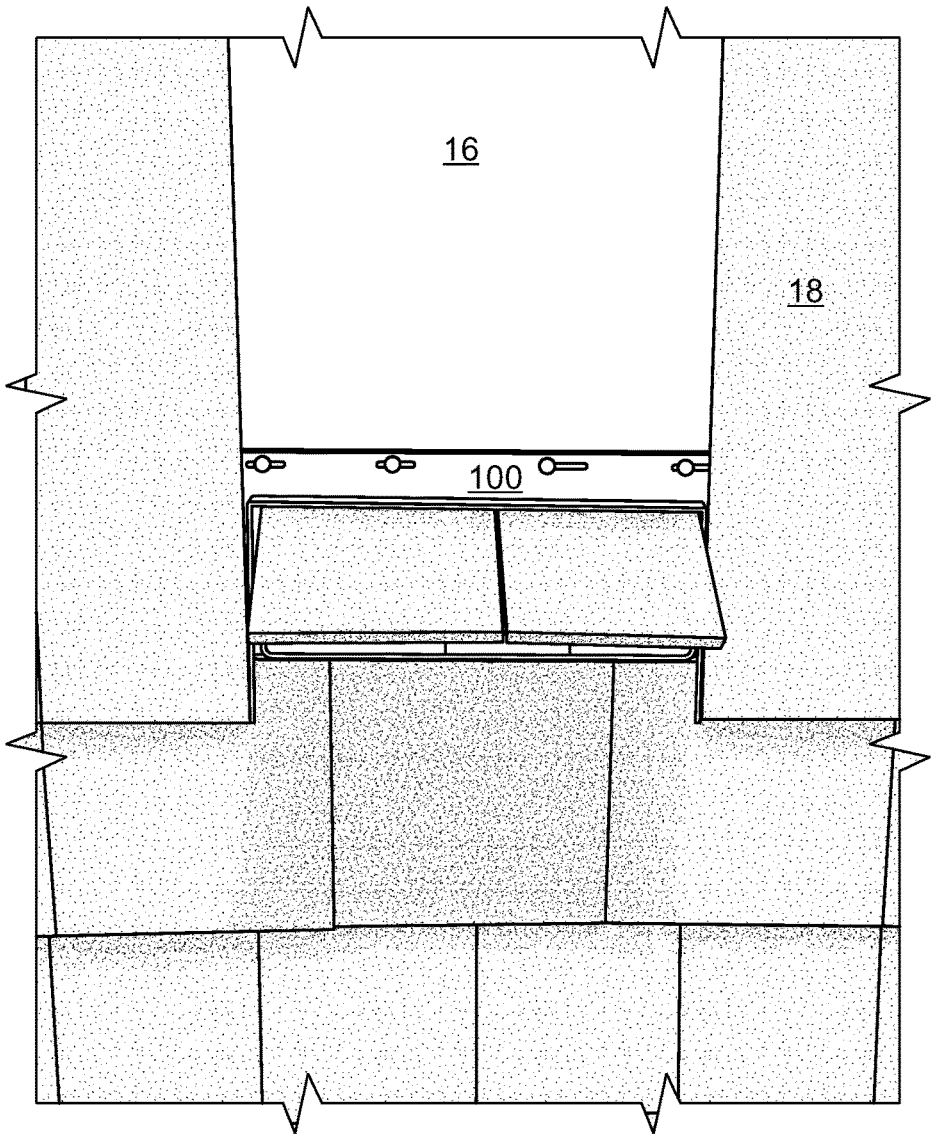
FIG. 3 is a perspective view of the air vent mounted directly to an exterior wall of a structure underneath the adjacent siding and shown in a non-operating or closed position. The air vent blends into the siding making substantially invisible.
Figure 4:
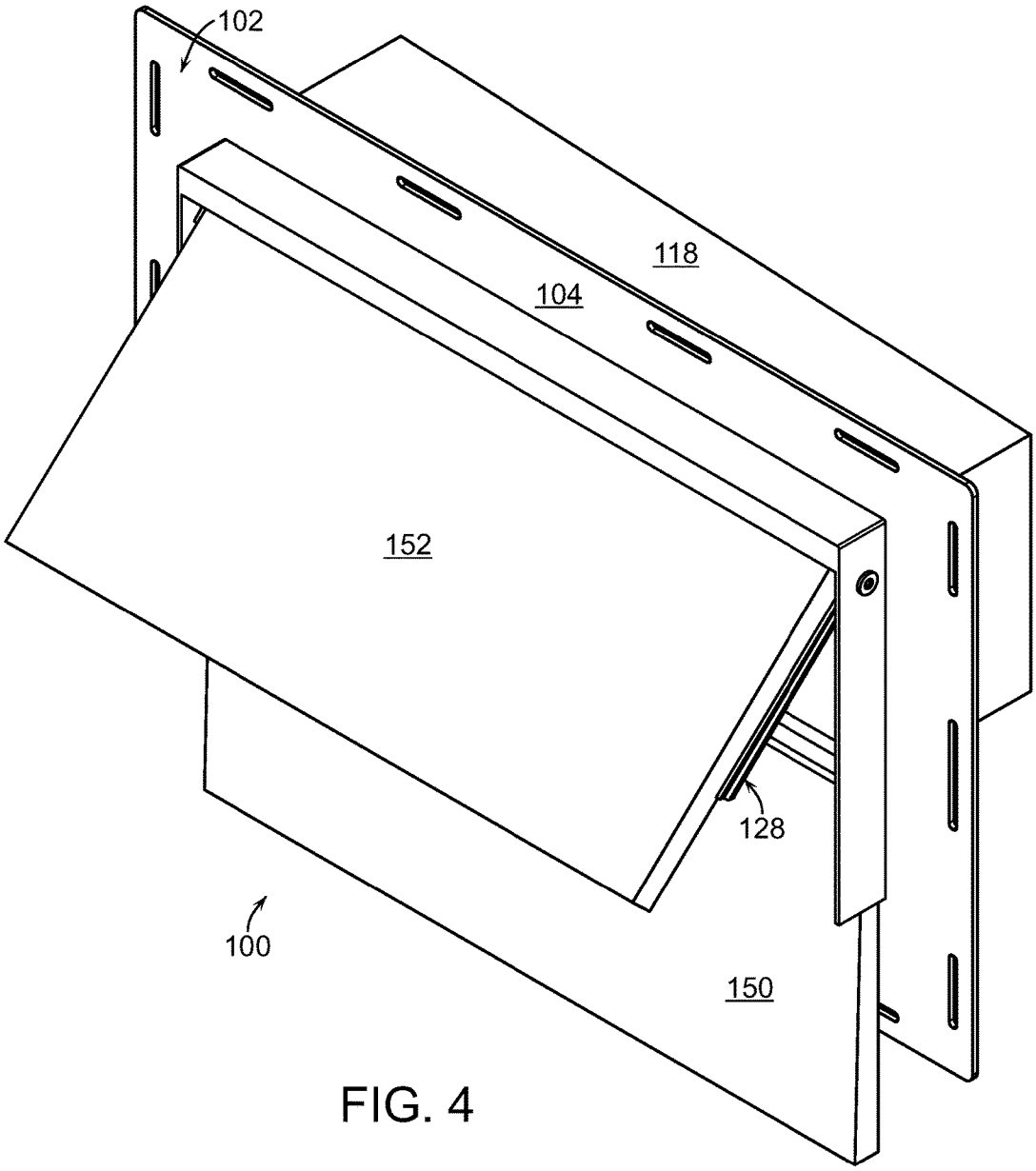
FIG. 4 is a top perspective view of the air vent shown in an operating or open position with first and second siding pieces mounted to the siding portion and damper, respectively.

Referring to FIGS. 2-6, the present invention is an air vent 100 adapted to mount directly to an exterior wall 16 of a structure having siding 18 to exhaust air from an interior space of the structure to the ambient environment. FIG. 2 shows air vent 100 in a non-operating or closed position where air vent 100 substantially blends into siding 18 of exterior wall 16 and air may not flow from the interior of the structure to the ambient. In contrast, FIG. 3 shows air vent 100 in an operating or open position where air may flow from the interior of a structure to the ambient. Air vent 10 generally comprises a body 102 having an opening 116, a damper 128 engaged with body 102 to block and unblock air flow thru opening 116, a first siding piece 150 secured to body 102 below opening 116, a second siding piece 152 secured to damper 128, and a rear duct 118 extending outward from body 102. First and second siding pieces 150 and 152 are selected to match the aesthetics of siding 18 of exterior wall 16 so as to blend in with siding 18 and become substantially invisible when in the non-operating or closed position (FIG. 2). Unlike conventional devices, air vent 100 provides a more attractive and ascetically pleasing siding 18 thereby increasing the value of the structure.

Figure 7:
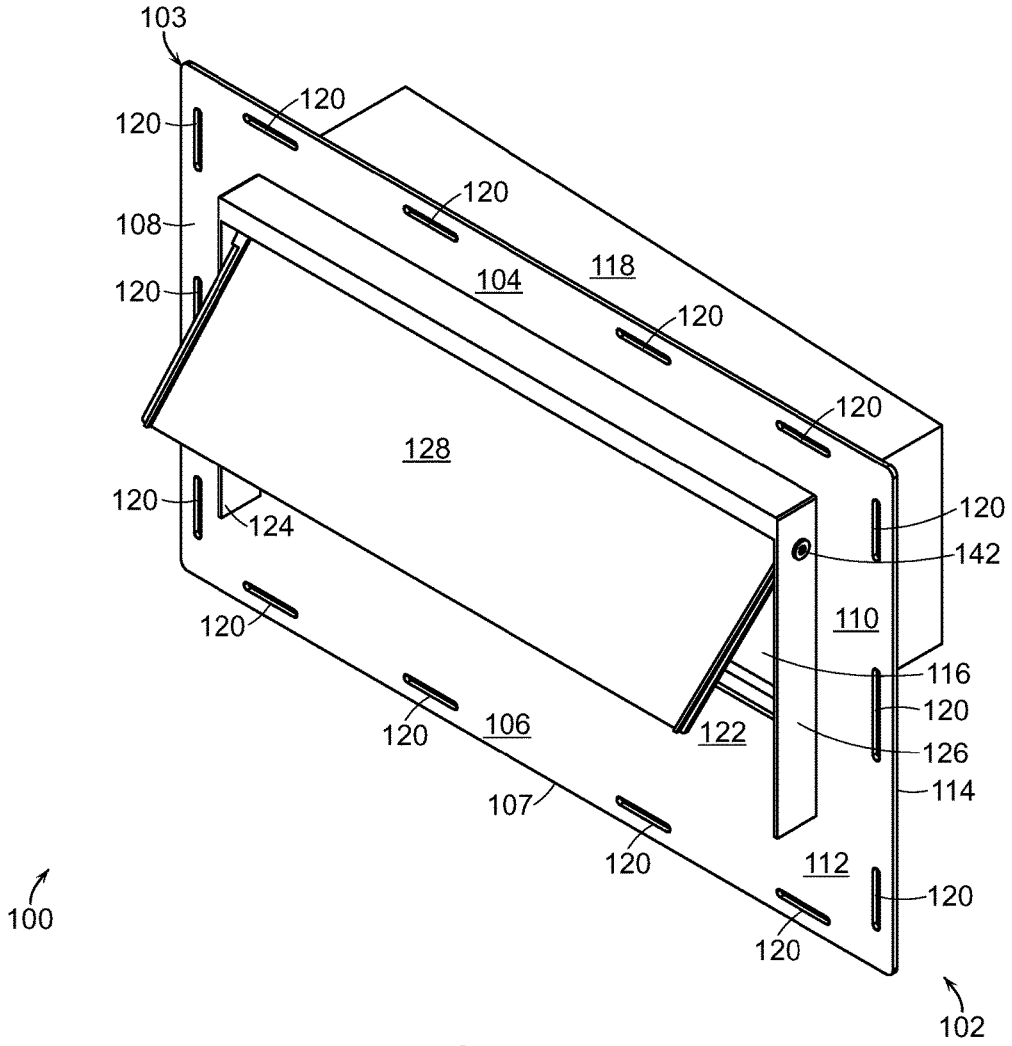
FIG. 7 is a top perspective view of the air vent with showing a damper attached to left and right flanges of a body.
Figure 8:
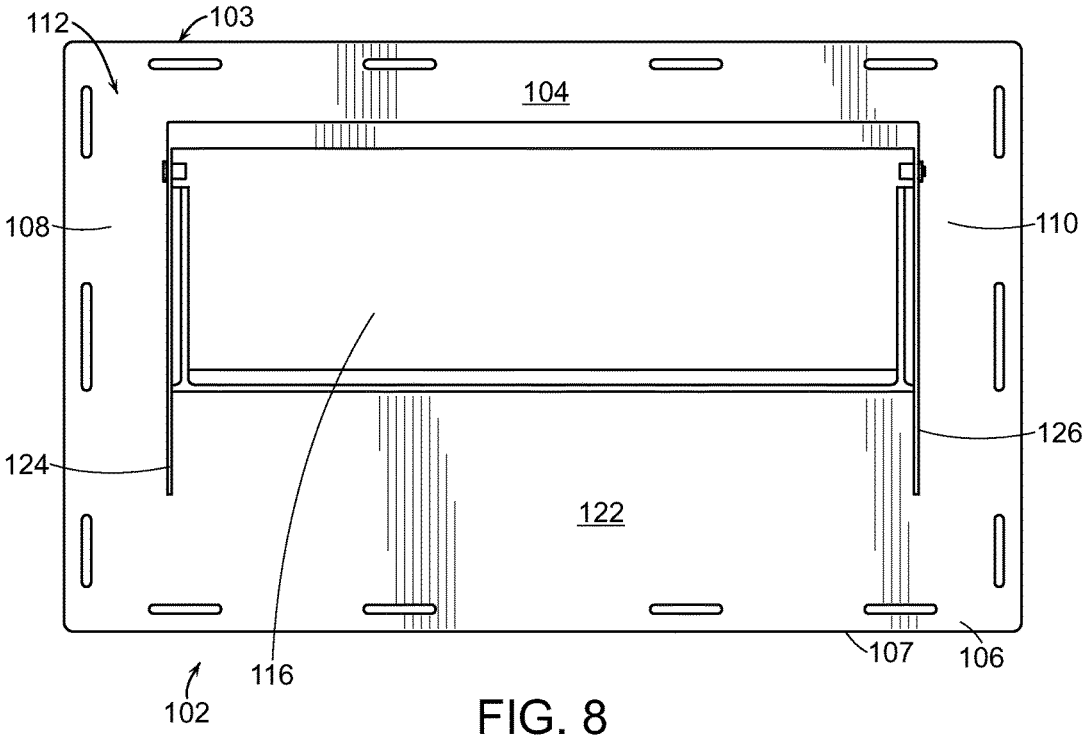
FIG. 8 is a front view of a body of the air vent.
Figure 9:
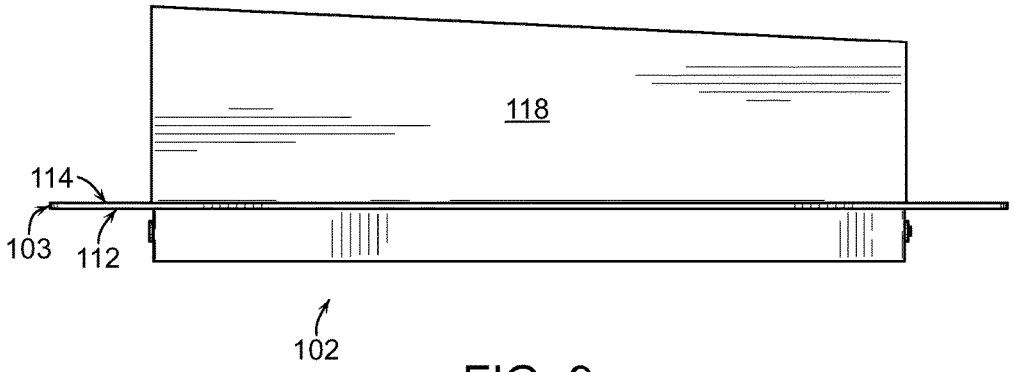
FIG. 9 is a top view of the body of the air vent.

Referring to FIGS. 7 and 8, body 102 generally comprises a base 103 having an outside surface or front face 112 and an inside surface or rear face 114. Outside surface 112 comprises a top portion 104, a bottom portion 106 having a bottom edge 107, a left side portion 108, and a right side portion 110. Body 102 further comprises an opening 116 centrally disposed in base 103 between left side portion 108 and right side portion 110. In the embodiment shown, opening 116 is rectangular shaped to accommodate rectangular shaped rear duct 118. In other embodiments, opening 116 may be circular shaped to accommodate a circular shaped rear duct 118 or of any other desired shape.

With continued reference to FIGS. 7 and 8, body 102 further comprises a first mounting flange 124 extending outward from outside surface 112 of left side portion 108 and disposed adjacent opening 116. Body 102 further comprises a second mounting flange 126 extending outward from outside surface 112 of right side portion 110 and disposed adjacent opening 116. Body 102 further comprises a lip 160 surrounding opening 116 to provide a water tight seal when damper 28 is closed. Lip 160 comprises a left wall 162, a front wall 164, and a right wall 166.

Figure 10:
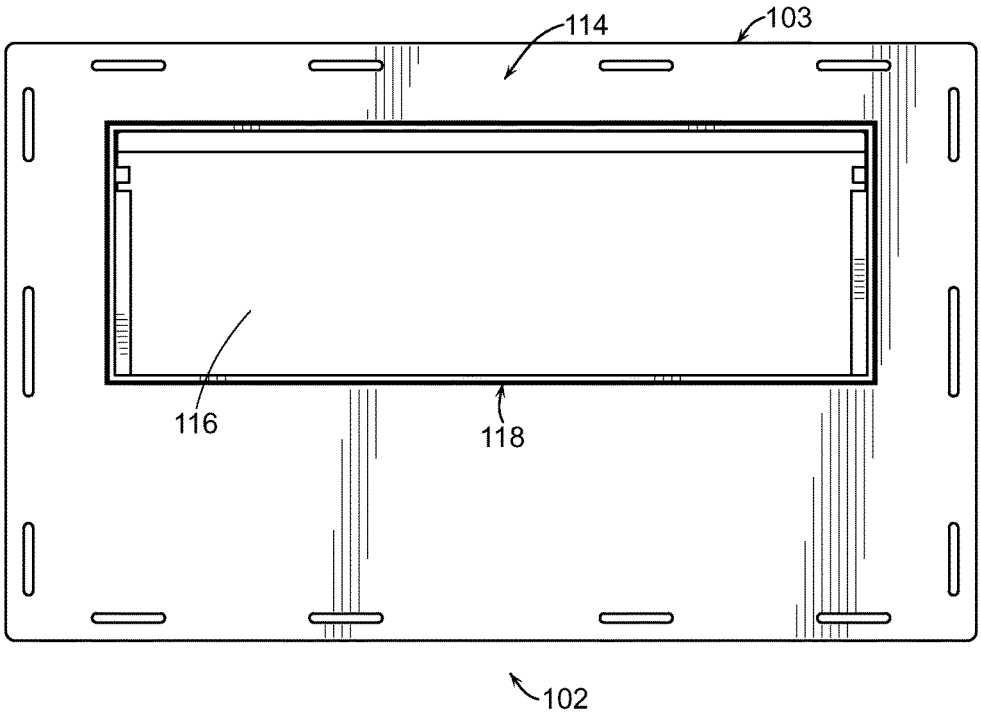
FIG. 10 is a rear view of the body of the air vent.
Figure 11:
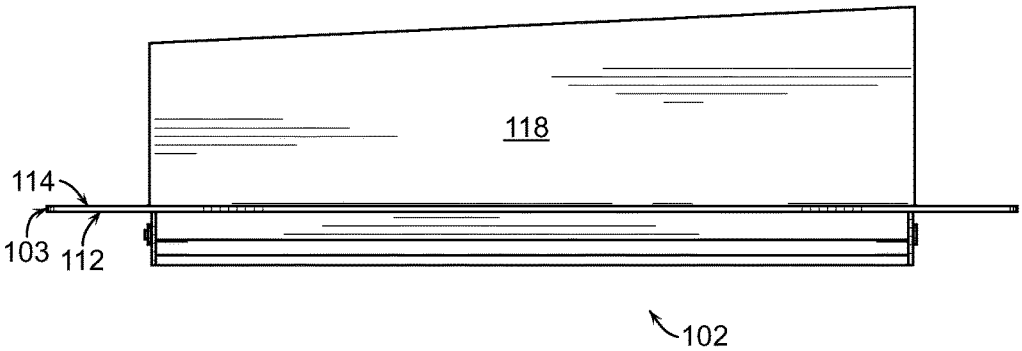
FIG. 11 is a bottom view of the body of the air vent.

Referring to FIGS. 7 and 10-11, rear duct 118 extends outward from inside surface 114 and is adapted to engage with a supply duct (not shown) located within an interior space of the structure. In the embodiment shown, rear duct 118 is rectangular shaped to accommodate a rectangular shaped supply duct. In other embodiments, rear duct 118 may be circular shaped to accommodate a circular shaped supply duct.

Referring to FIGS. 7 and 8, body 102 further comprises a plurality of slots 120 disposed along top portion 104, bottom portion 106, left side portion 108, and right side portion 110. Slots 120 are provided so that body 102 may be mounted directly to an exterior wall by nails, screws, staples, or other fastening means.

Figure 6:
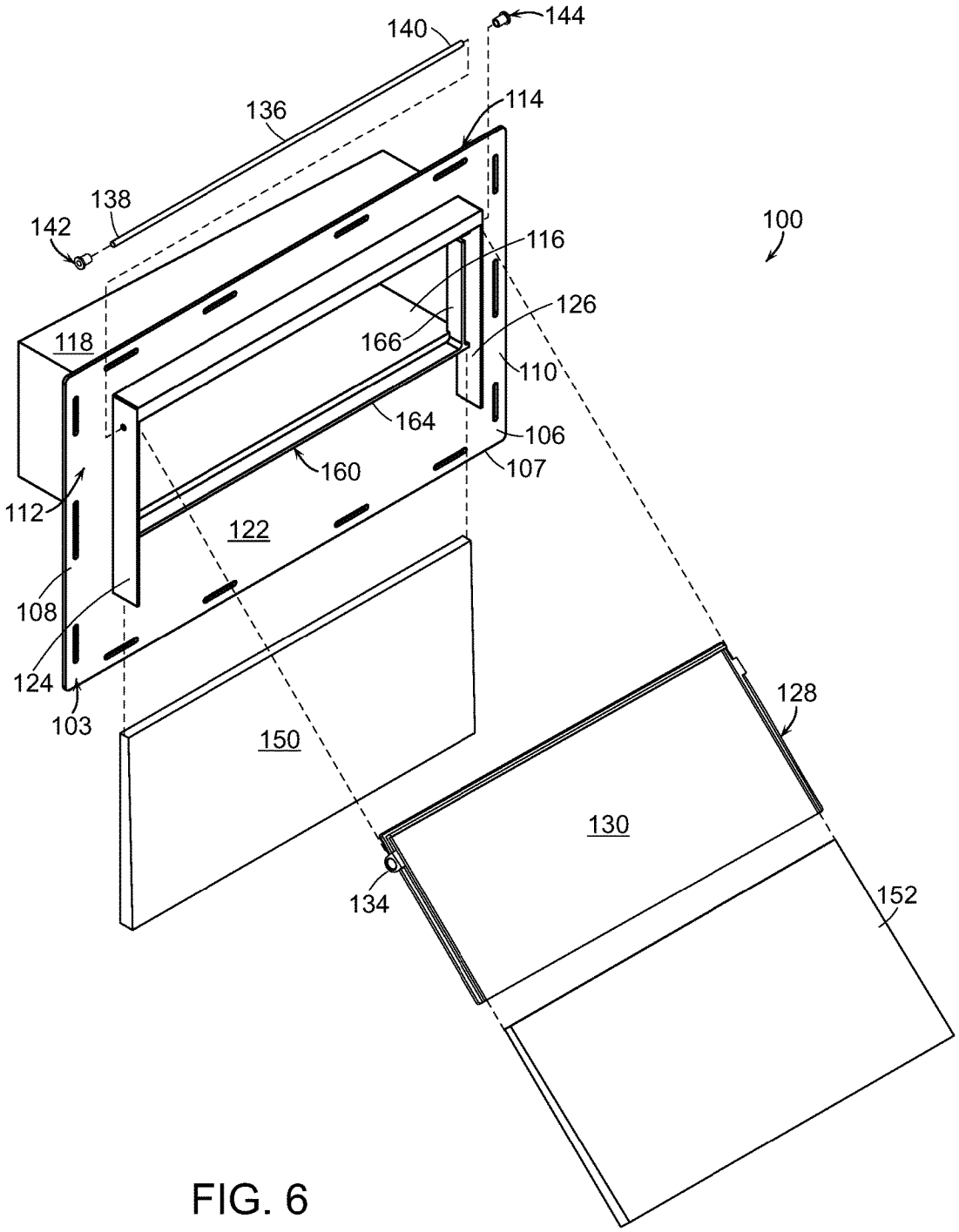
FIG. 6 is an exploded view of the air vent.

Referring to FIGS. 6 and 8, body 102 further comprises a siding portion 122 disposed between first and second mounting flanges 124 and 126 and extending substantially from opening 116 to bottom edge 107. Siding portion 122 is designed to securely receive one or more siding pieces 150 and has a width substantially equal to the width or diameter of opening 116. Siding portion 122 is of sufficient size to receive one or more siding pieces 150 which are secured thereto by adhesive or other fastening means. Siding piece 150 is selected to match the siding used for the exterior wall surrounding the air vent 100. Body 102 is a made from plastic and constructed as a single article by conventional molding processes.

Figure 5:
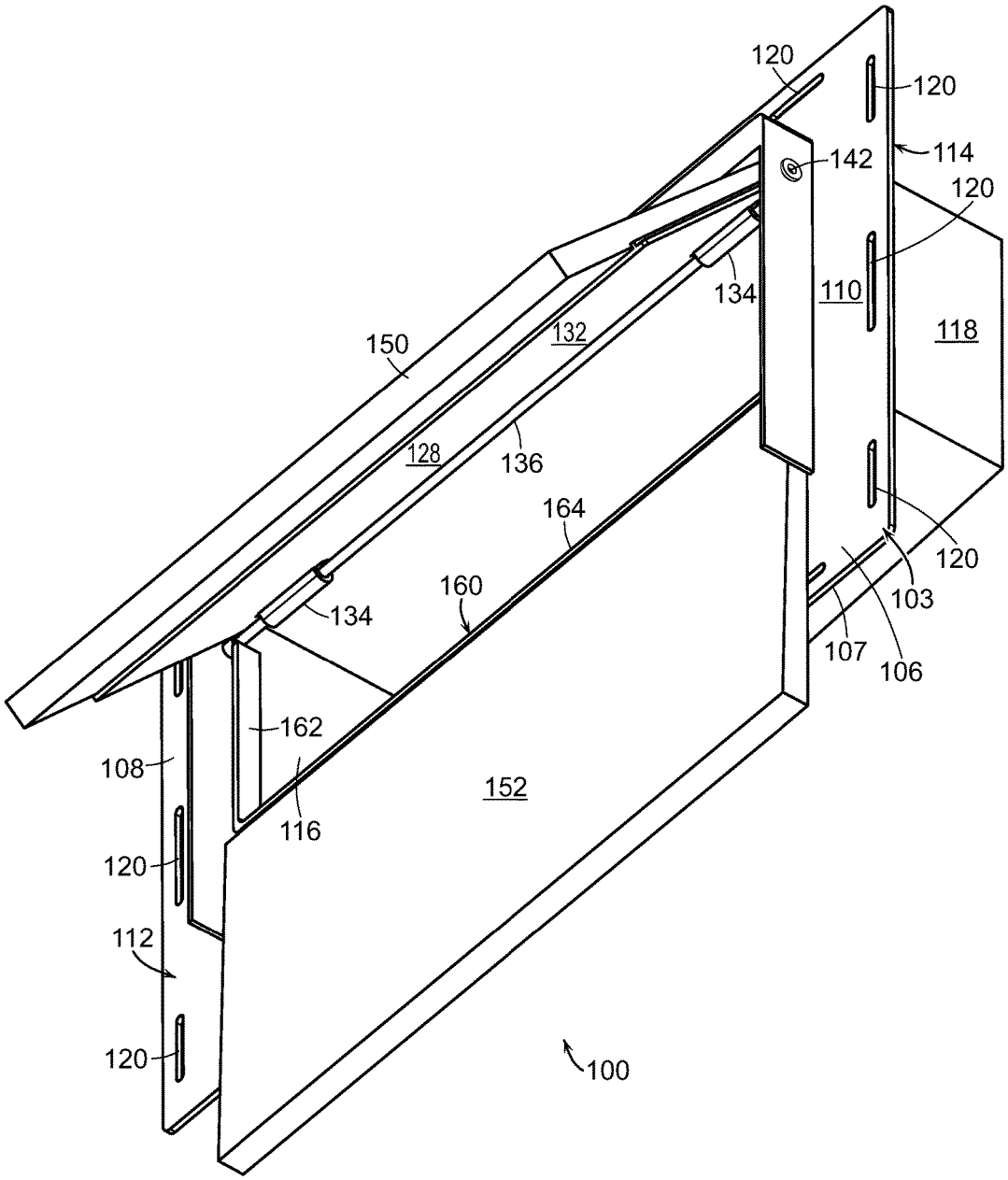
FIG. 5 is a top perspective view of the air vent shown in an operating or open position with first and second siding pieces mounted to the siding portion and damper, respectively.

Referring to FIGS. 5-6, damper 128 is rotatably engaged with first and second mounting flanges 124 and 126 from a non operating or closed position where damper 128 covers or blocks opening 116 to prevent air flow and an operating or open position where damper 128 is spaced apart from opening 116 allowing air flow. Damper 128 further comprises a left rail 132 and a right rail 133 that provide a guide or assist in placement of second siding piece 152 on outside surface 130 of damper 128. In the embodiment shown, air vent 100 further comprises a rod 136 having a first end 138 secured to first mounting flange 124 by a bushing 142 and a second end 140 secured to second mounting flange 126 by a bushing 144. Air vent 100 further comprises hinges 134 mounted to an inside surface 131 of damper 128. Rod 136 is inserted thru hinges 134 and ends 138 and 140 are secured to bushings 142 and 144, respectively, which are secured to first and second mounting flanges 124 and 126, respectively. Bushings 142 and 144 may be any type of widely available bushing. Hinges 134 may be any type of widely available hinge. Rod 132 is made from metal but may be made from any durable material. In the embodiment shown, damper 128 is rectangular shaped to accommodate a rectangular duct. In other embodiments, damper 128 may be circular shaped to accommodate a circular shaped duct.

Figure 12:
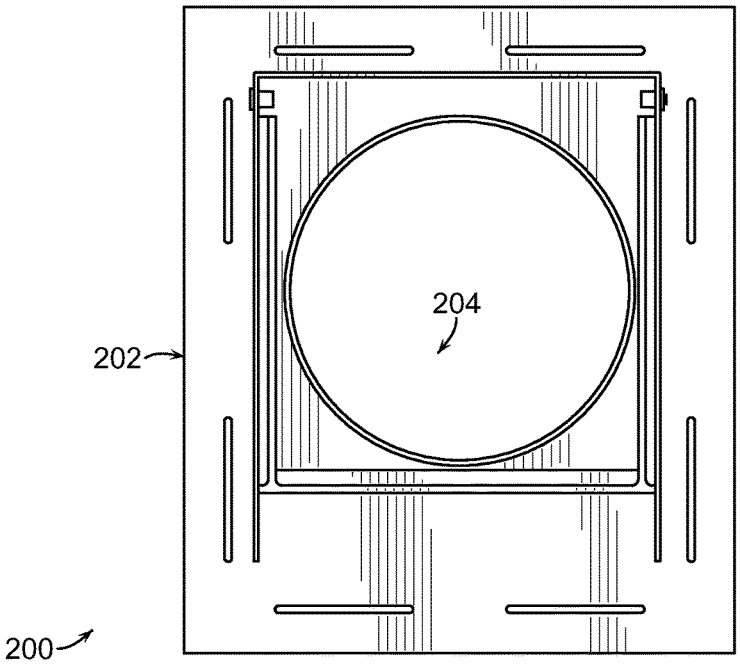
FIG. 12 is a front view of a second embodiment of the air vent according to the present invention comprising a circular shaped opening and a circular shaped rear duct for engagement with a circular shaped supply duct.

Referring to FIG. 12, where an air vent 20 according to a second embodiment of the present invention comprises a body 202 and circular shaped opening 204. Body 202 further comprises a circular shaped rear duct (not shown) for engagement with a circular shaped supply duct (not shown). All other features of air vent 200 are the same as described for air vent 100.

While particular embodiments of the invention have been shown and described, it will be obvious to those skilled in the art that changes and modifications may be made without departing from the scope of the claimed invention.

What is claimed:

1. An air vent for mounting directly to an exterior wall of a structure to allow air flow from an interior space of the structure to the ambient environment, and for use with a first siding piece and a second siding piece substantially similar in appearance to the exterior wall, the air vent comprises:

a body comprising an opening and a siding portion disposed below said opening; said body further comprising a rear duct aligned with said opening; said siding portion of said body being adapted to receive the first siding piece; and a damper moveably engaged with said body between a closed position where said damper blocks air flow thru said opening and an open position where said damper allows air flow thru said opening; and said damper comprises a left rail for assisting in placement of the second siding piece a top said damper to overlap the first siding piece in said closed position thereby making said damper substantially invisible.

2. The air vent of claim 1, wherein said damper comprises an outside surface; said left rail extends along said outside surface.

3. The air vent of claim 2, wherein said damper further comprises a right rail for assisting in placement of the second siding piece a top said damper to overlap the first siding piece in said closed position thereby making said damper substantially invisible.

4. The air vent of claim 3, wherein said right rail extends along said outside surface.

5. The air vent of claim 4, wherein said body further comprises a base comprising a front face and a rear face; said front face comprises a top portion and a bottom portion terminating at a bottom edge; said front face further comprises left and right side portions.

6. The air vent of claim 5, wherein said body further comprises first and second mounting flanges extending outward from said left and right side portions.

7. The air vent of claim 6, wherein said siding portion is disposed between said first and second mounting flanges and substantially extends from said opening to said bottom edge.

8. The air vent of claim 7, wherein said rear duct extends outward from said inside surface of said base.

9. The air vent of claim 8, wherein said body further comprises at least one slot formed in each of said top and bottom portions and each of said left and right side portions to secure said body to the exterior wall.

10. The air vent of claim 9, further comprising a rod rotatably engaging said damper to said first and second mounting flanges.

11. The air vent of claim 10, wherein said rod comprises a first end engaged with said first mounting flange and a second end engaged with said second mounting flange; said damper being rotatable about said rod.

12. The air vent of claim 11, wherein said body further comprises a lip surrounding said opening; said lip comprises a left wall, a right wall, and a front wall.

13. The air vent of claim 12, wherein said siding portion extends from said front wall of said lip to said bottom edge.

14. The air vent of claim 13, wherein said siding portion has a width substantially equal to the width of said opening.

15. The air vent of claim 1, wherein said opening is rectangular shaped.

16. The air vent of claim 1, wherein said opening is circular shaped.

17. The air vent of claim 1, wherein said rear duct is rectangular shaped.

18. The air vent of claim 1, wherein said rear duct is circular shaped.

19. The air vent of claim 1, wherein said body is made from a single piece of material.

20. The air vent of claim 1, wherein said body is made from plastic and said damper is made from plastic.

* * * * *